US006412303B1

(12) United States Patent
Lee

(10) Patent No.: US 6,412,303 B1
(45) Date of Patent: Jul. 2, 2002

(54) ARTICLE OF JEWELRY HAVING AN ELASTIC MEMBER

(76) Inventor: Chung-Hoon Lee, 24 Marbourne Dr., Mamaroneck, NY (US) 10543

( * ) Notice: Subject to any disclaimer, the term of this patent is extended or adjusted under 35 U.S.C. 154(b) by 0 days.

(21) Appl. No.: 09/625,529

(22) Filed: Jul. 26, 2000

(51) Int. Cl.[7] ..... A44G 5/00
(52) U.S. Cl. ..... 63/3; 59/79.1; 63/4; 63/11
(58) Field of Search ..... 63/3, 4, 11; 59/79.1, 59/79.3

(56) References Cited

U.S. PATENT DOCUMENTS

| | | | | | |
|---|---|---|---|---|---|
| 1,099,810 | A | * | 6/1914 | Mehrlust | 63/11 |
| 1,403,600 | A | * | 1/1922 | Grand et al. | 63/11 |
| 1,570,932 | A | * | 1/1926 | Anderson et al. | 63/11 |
| 5,630,329 | A | * | 5/1997 | Lauffer et al. | 63/11 |
| 5,694,791 | A | * | 12/1997 | Esposito | 63/11 |

* cited by examiner

*Primary Examiner*—Anthony Knight
*Assistant Examiner*—E Peavey
(74) *Attorney, Agent, or Firm*—Thomas A Gallagher

(57) ABSTRACT

An article of jewelry includes a plurality of settings coupled to each other by slidable links and an elastic member threaded through the settings extending substantially parallel to the links in a "string". The settings may include stones or any other decorative element. According to one embodiment, the ends of the string are coupled to each other without the use of a clasp. The elasticity of the elastic member keeps the settings close together with little or no space between them but allows the string to be stretched thereby separating the settings by the length of the links. According to the first embodiment, where no clasp is used, the string and the links are dimensioned such that when the string is stretched the article can be fit over a body part such as a wrist or ankle and remain in place when released. According to the second embodiment which utilizes a clasp, the string may be dimensioned to fit around a human neck like a choker and the elastic member will allow for some variation in neck size.

8 Claims, 3 Drawing Sheets

ARTICLE OF JEWELRY HAVING AN ELASTIC MEMBER

BACKGROUND OF THE INVENTION

1. Field of the Invention

The invention relates to an article of jewelry. More particularly, the invention relates to an article of jewelry which includes a number of decorative elements coupled to each other by links and having an elastic member.

2. State of the Art

Jewelry, and particularly costume jewelry, is very popular among women of all ages. FIG. 1 illustrates a prior art article of jewelry 10 which includes a plurality of decorative members 12, 14, 16, etc. Coupled to each other in a "string" with a clasp 18 coupling the ends of the string together. Such an article of jewelry is typically a bracelet or a necklace and the decorative members are typically stones, e.g. rhinestones. Prior art FIGS. 2 and 3 illustrate how the article of jewelry 10 is assembled. As shown in FIG. 2, a plurality of settings 20, 22, 24, 26, etc. are coupled to each other by a plurality of links 28, 30, 32, 34, etc. As shown in FIG. 3, stones 36, 38, 40, 42, etc. are set in the settings 20, 22, 24, 26, etc. to create the string of stones. In mass production, a string many yards long is produced using a machine. Small strings are then cut off by hand and the clasp applied to the smaller string. According to one popular prior art embodiment, the settings 20, 22, 24, 26, etc. are metallic boxes having an inverted generally T-shaped slot at opposite ends; and the links 28, 30, 32, 34, etc. are generally I-shaped metallic members. The dimensions of the slots and the links are such that the settings are free to slide apart from each other as shown in FIGS. 1–3. Although the settings are also free to slide close to each other, the weight of the stones and the settings usually keeps the settings spaced apart from each other as shown.

SUMMARY OF THE INVENTION

It is therefore an object of the invention to provide an article of jewelry having a plurality of settings which are free to be moved apart from each other but which are held in close proximity with virtually no space between them.

It is also an object of the invention to provide an article of jewelry having a plurality of settings coupled to each other in a "string" which does not require a clasp.

In accord with these objects which will be discussed in detail below, the article of jewelry of the present invention includes a plurality of settings coupled to each other by slidable links and an elastic member threaded through the settings substantially parallel to the links in a "string". The settings may include stones or any other decorative element. According to one embodiment, the ends of the string are coupled to each other without the use of a clasp. The elasticity of the elastic member keeps the settings close together with little or no space between them but allows the string to be stretched thereby separating the settings by the length of the links. According to the first embodiment, where no clasp is used, the string and the links are dimensioned such that when the string is stretched the article can be fit over a body part such as a wrist or ankle and remain in place when released. According to the second embodiment which utilizes a clasp, the string may be dimensioned to fit around a human neck like a choker and the elastic member will allow for some variation in neck size.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
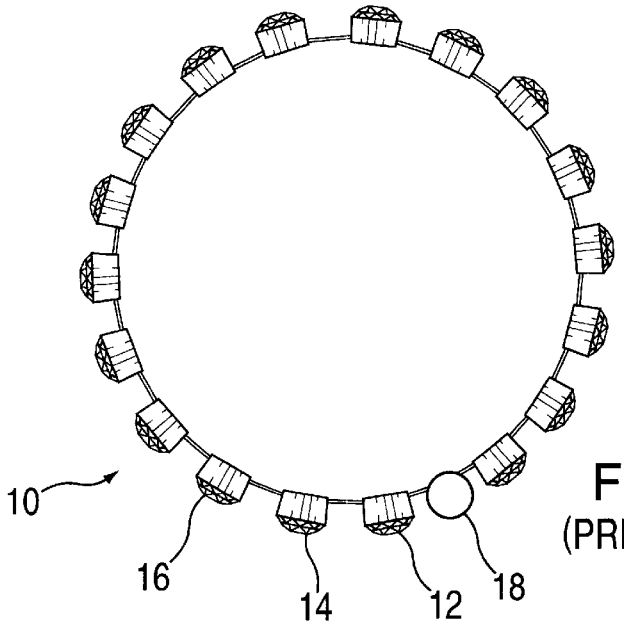
FIG. 1 (PRIOR ART)
FIG. 1 is plan view of a prior art bracelet.
Figure 2:
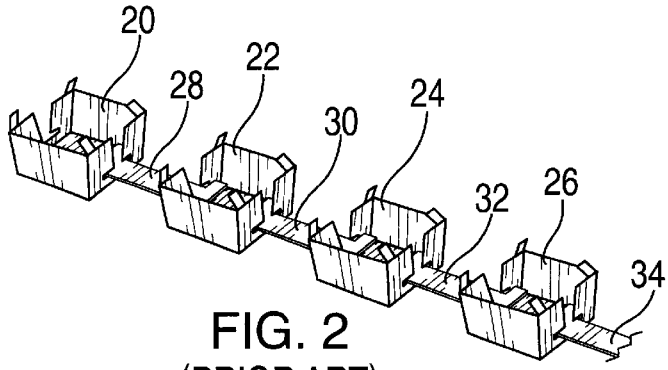
FIG. 2 (PRIOR ART)
FIG. 2 is a broken perspective view of the settings and links of the bracelet of FIG. 1 prior to the setting of stones.
Figure 3:
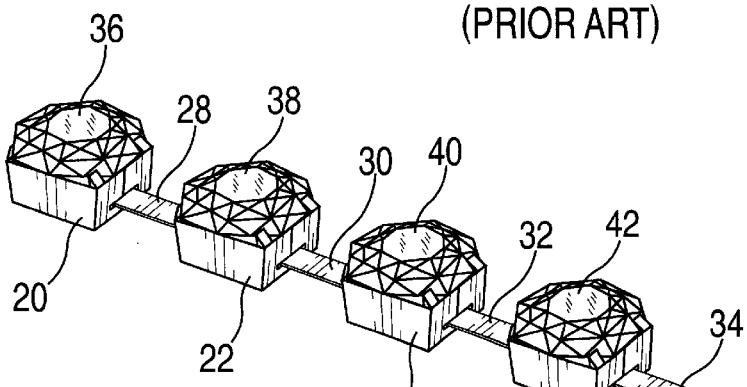
FIG. 3 (PRIOR ART)
FIG. 3 is a broken perspective view of the settings and links of the bracelet of FIG. 1 with stones set in the settings.
Figure 4:
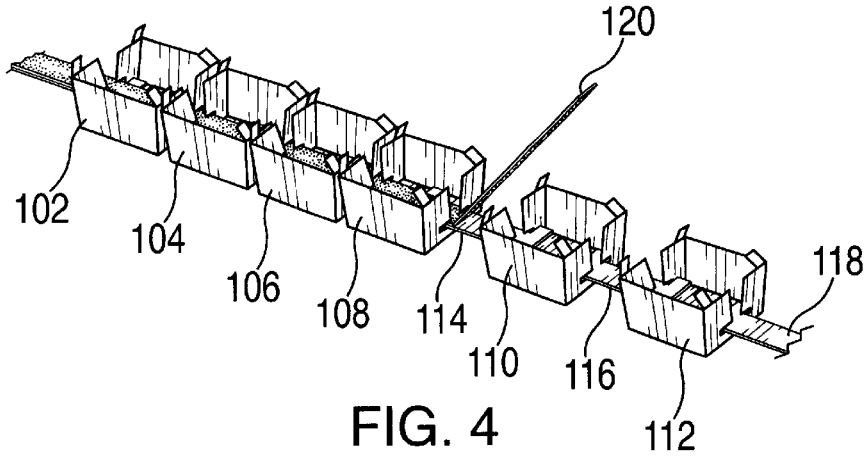
FIG. 4 is a view similar to FIG. 2 illustrating the placement of the elastic member according to the invention.

Referring now to FIG. 4, an article of jewelry according to the invention includes a plurality of settings 102, 104, 106, 108, 110, 112, etc. coupled to each other by slidable links, e.g. 114, 116, 118 to form a string. An elastic member 120 is threaded through the settings substantially parallel to the links. During the intermediate stage of manufacture illustrated in FIG. 4, it is not necessary that the elastic member be fastened to any of the settings or links. It may be desirable to fasten some portion of the elastic member to a link or a setting to keep it in place until the decorative elements are mounted in the settings. According to the presently preferred embodiment, the links and settings are the same as the prior art links and settings described above with reference to FIGS. 2 and 3 and the elastic member 120 is a long continuous member which is threaded through the slots in the settings on top of the links.

Figure 5:
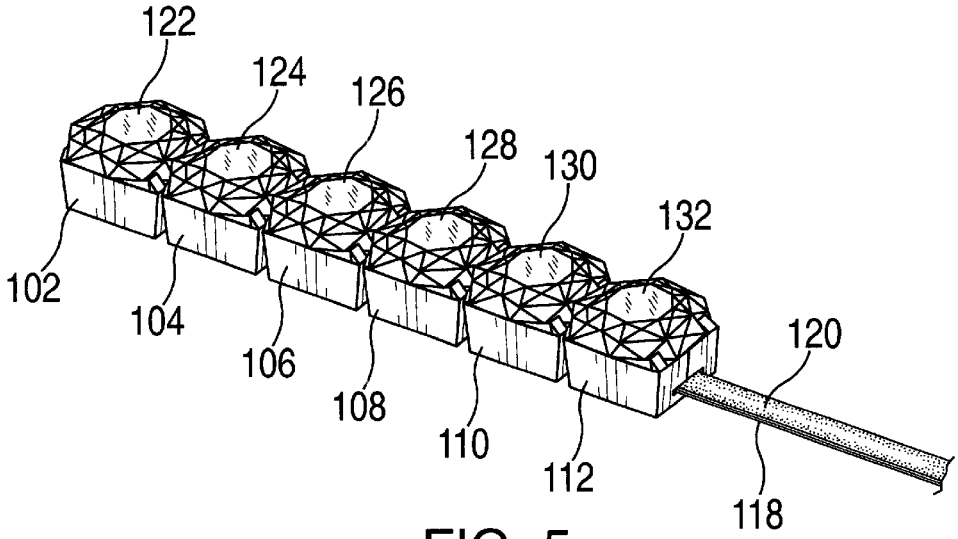
FIG. 5 is a view similar to FIG. 3 illustrating how the elastic member holds the settings in close proximity.
Figure 6:
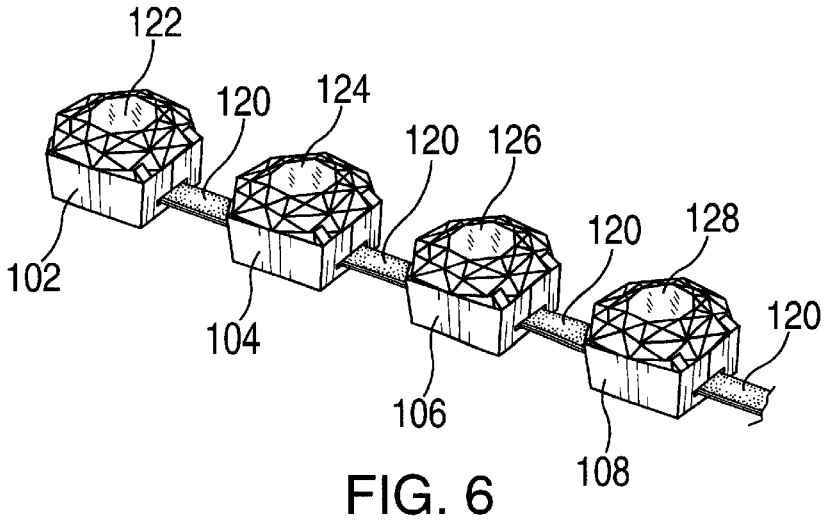
FIG. 6 is a view similar to FIG. 5 illustrating how the elastic member and links allow the settings to be moved apart from each other.

FIGS. 5 and 6 illustrate the article of jewelry after stones 122–132 have been set in setting 102–112. FIG. 5 illustrates how the settings will be held close to each other by the elastic member when the elastic member is coupled to compress the string together. FIG. 6 illustrates how to the settings may be moved apart under tension of the elastic member. Although the settings are shown with stones, any other decorative element may be used.

Figure 7:
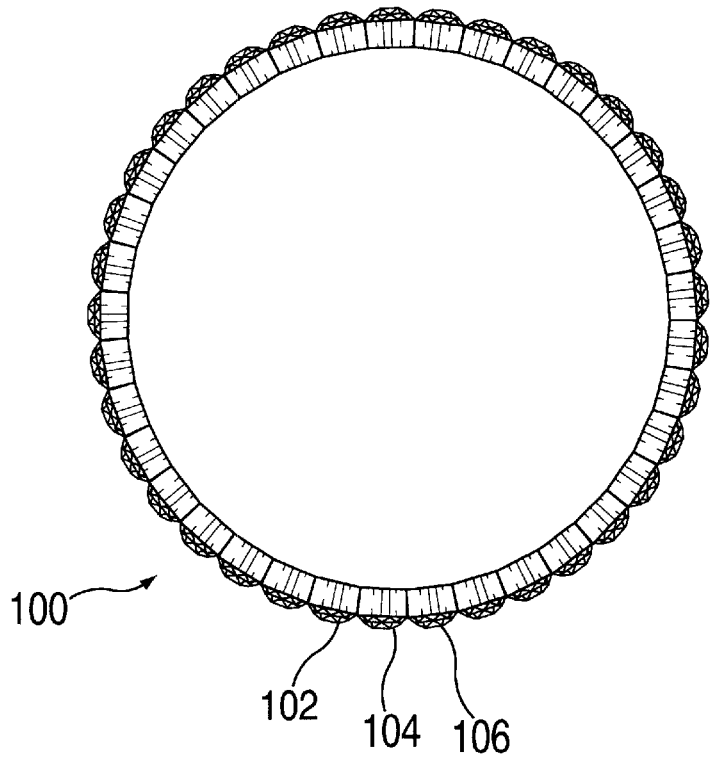
FIG. 7 is a plan view of an article of jewelry according to a first embodiment having no clasp.

Turning now to FIG. 7, according to a first embodiment 100, the ends of the string of decorative elements are coupled to each other to form an endless loop having no clasp. The ends of the elastic member are similarly coupled to hold the settings close to each other as shown in FIG. 7.

Figure 8:
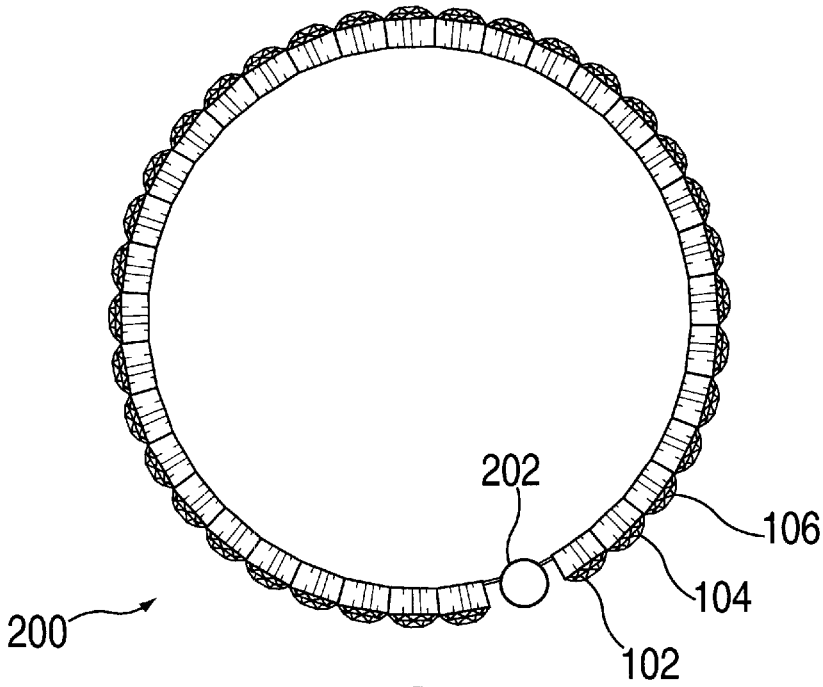
FIG. 8 is a plan view of an article of jewelry according to a second embodiment having a clasp.

Turning now to FIG. 8, according to a second embodiment 200, the ends of the string are coupled to mating portions of a clasp 202. In this embodiment, at each end of the string, the ends of the elastic member are coupled to either a setting, a link, or a mating portion of the clasp to hold the settings close to each other as shown in FIG. 8.

According to the first embodiment, where no clasp is used, the string and the links are dimensioned such that when the string is stretched the article can be fit over a body part such as a wrist or ankle and remain in place when released. According to the second embodiment which utilizes a clasp, the string may be dimensioned to fit around a human neck like a choker and the elastic member will allow for some variation in neck size.

There have been described and illustrated herein several embodiments of an article of jewelry. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. An article of jewelry comprising:

a) a plurality of settings;

b) a plurality of slidable links coupling said settings together in a string; and c) a longitudinally extensible elastic member extending through said setting substantially parallel to said links, such that said article of jewelry can stretch and fit over a body part.

2. An article of jewelry according to claim 1, further comprising:

d) a plurality of decorative elements mounted in said settings.

3. An article of jewelry according to claim 2, wherein:

said string has a first end and a second end which are coupled to each other to form an endless loop without a clasp.

4. An article of jewelry according to claim 3, wherein:

said elastic member has a first end and a second end, said first end of said elastic member being coupled to one of the second end of said elastic member, a link, and a setting, and said second end of said elastic member being coupled to one of the first end of said elastic member, a link, and a setting.

5. An article of jewelry according to claim 2, further comprising:

e) a clasp having first and second mating portions;

said string having a first end coupled to said first mating portion and a second end coupled to said second mating portion.

6. An article of jewelry according to claim 5, wherein:

said elastic member has a first end and a second end, said first end of said elastic member being coupled to one of said first mating portion, a link, and a setting, and said second end of said elastic member being coupled to one of said second mating portion, a link, and a setting.

7. An article of jewelry comprising:

a) a plurality of settings:

b) a plurality of slidable links coupling said settings together in a string; and c) an elastic member extending through said settings substantially parallel to said links, wherein said string has a first end and a second end which are coupled to each other to form an endless loop without a clasp, and said elastic member and said slidable links allow said endless loop to expand and contract, such that said article of jewelry can stretch and fit over a body part.

8. An article of jewelry comprising;

a) a plurality of settings;

b) a plurality of slidable links coupling said settings together in a string; and c) an elastic member extending through said settings substantially parallel to said links; and d) a clasp having first and second mating portions, said string having a first end coupled to said first mating portion and a second end coupled to said second mating portion, wherein said string has a first end and a second end which are coupled to each other to form an endless loop without a clasp, and when said first and second mating portions of said clasp, and mated, said elastic member and said slidable links allow said endless loop to expand and contract, such that said article of jewelry can stretch and fit over a body part.

* * * * *